United States Patent [19]

Schrader et al.

[11] 4,313,418

[45] Feb. 2, 1982

[54] DAMPER CONTROL

[75] Inventors: Charles I. Schrader, Eugene, Oreg.; Janice E. Schrader, 2296 Debra Dr., Springfield, Oreg. 97477

[73] Assignee: Janice E. Schrader, Springfield, Oreg.

[21] Appl. No.: 131,477

[22] Filed: Mar. 18, 1980

[51] Int. Cl.[3] ..... F24C 1/14

[52] U.S. Cl. ..... 126/287; 126/77; 126/193; 126/289

[58] Field of Search ..... 126/77, 78, 80, 81, 126/83, 193, 285 R, 289, 290, 146, 120, 121

[56] References Cited

U.S. PATENT DOCUMENTS

| | | | |
|---|---|---|---|
| 2,352,057 | 6/1944 | Wingert | 126/287 |
| 2,709,551 | 5/1955 | Bower et al. | 126/77 |
| 2,864,358 | 12/1958 | Harding | 126/77 |
| 4,180,051 | 12/1979 | Maier et al. | 126/77 |
| 4,182,305 | 1/1980 | Johnson | 126/120 |

*Primary Examiner*—James C. Yeung

*Attorney, Agent, or Firm*—Klarquist, Sparkman, Campbell, Leigh, Whinston & Dellett

[57] ABSTRACT

A damper control system wherein a control screw is threadedly mounted in a door and engages a depending contact arm on a damper to move the damper between a closed position and various open positions.

7 Claims, 3 Drawing Figures

DAMPER CONTROL

BACKGROUND OF THE INVENTION

This invention relates to wood stoves and particularly to a damper control for a wood stove. In a previous wood stove a pivoted damper was actuated by a control member from the side of the stove.

The present invention provides a control arrangement for the damper of a wood burning or similar stove by providing a control element in the form of a screw which threadedly extends through a nut on the door, and has a crank whereby the extent of inward projection of the control element can be varied. The damper has a depending arm engaged by the damper control element to enable the control element to move the damper closed or to dispose it at various open positions. The control arm is so dimensioned relative to the interior of the stove as to abut against the interior portion of the stove whenever the door is opened to dispose the damper at a predetermined open position.

A main object of the invention is to provide an improved damper control for a wood stove.

Various other objects of the invention will be apparent from the following description taken in connection with the accompanying drawings, wherein.

Figure 1:
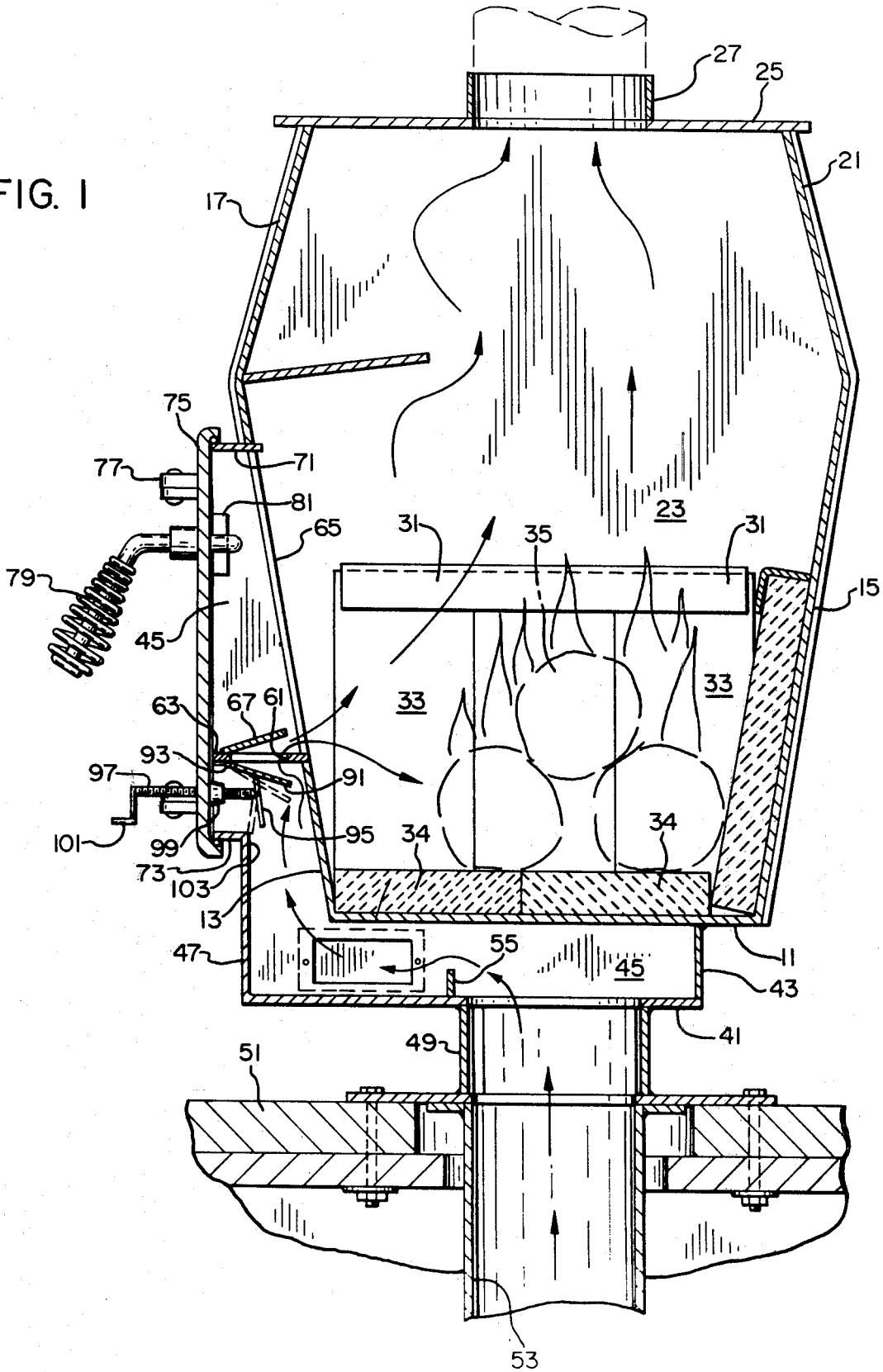
FIG. 1 is a vertical midsectional view through a stove embodying the concepts of the present invention.

FIG. 1 shows a wood stove for mobile home application. The stove has a lower wall 11 from which project upwardly and outwardly front and rear walls 13 and 15 which have upper portions 17 and 21 which taper upwardly and inwardly. There are similar side walls 23, one of which is shown in FIG. 1. There is a top wall 25 having an outlet flue 27.

The interior of the stove has fire brick retaining elements 31 on the side and rear walls to retain fire brick 33 in proper relation to a fire brick floor 34. Logs or other fuel 35 burn on the grate thus provided.

Air is supplied to the interior of the stove in the following fashion. Disposed beneath and extending around to the front of the stove is an air passageway defined by a bottom wall 41, a rear wall 43, and side walls 45 and a front wall 47. The structure defining the passageway 45 is supported by a hollow pedestal 49 bolted to the floor 51 of the mobile home or like structure. An inlet pipe 53 supplies ambient air to the hollow pedestal 49. This air flows upwardly and over a barrier 55, then forwardly and then upwardly through an opening 61 formed in a damper wall 63. The air then flows through an opening 65 formed in the front wall 13 of the stove and passes into the combustion chamber being in part deflected toward the fuel 35 and in part upwardly by a fixed deflector 67 secured to the wall 63.

Figure 2:
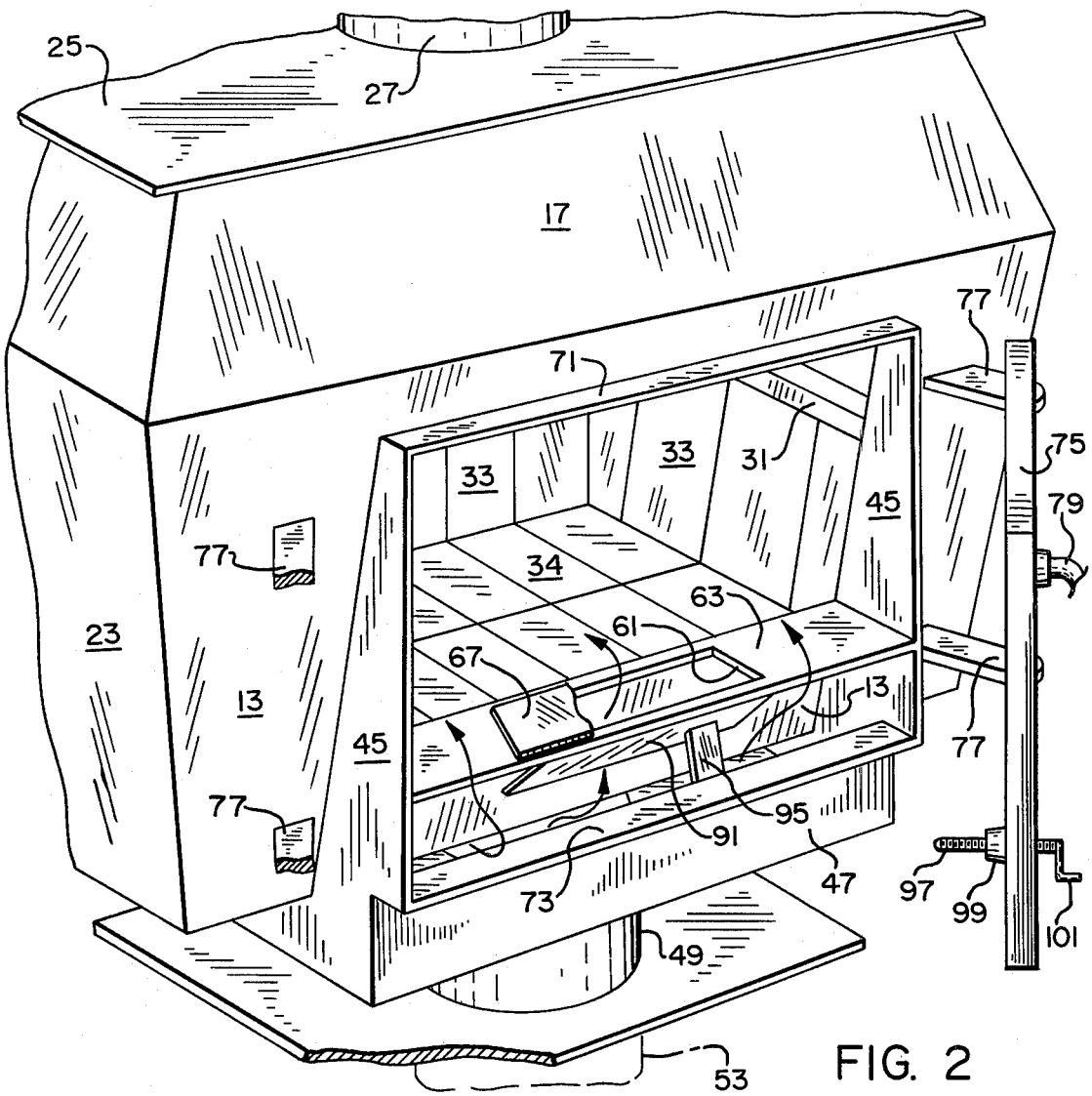
FIG. 2 is a front perspective view of the stove showing the door open.

The walls 45 extend upwardly as shown in FIG. 2 and together with an upper wall 71 and a lower wall 73 define a forwardly projecting opening closed by a door 75. The door is mounted by hinges 77 for swinging movement from the closed position shown in FIG. 1 to the open position shown in FIG. 2. A handle 79 on the door enables it to be locked closed by a suitable catch at 81 (FIG. 1) or to be opened if desired.

When the door is open, air can not only flow into the stove upwardly from the pipe 53 and pass through the damper opening 61, but can also pass directly inwardly from the front of the stove. However, when the door is closed, the only way air can enter the stove is through the opening 61.

The amount of air to flow through the opening 61 is controlled by a damper 91 pivoted at 93 (FIGS. 1 and 3) on the wall 63. The damper has a depending arm 95 which is oblique to the plane of the damper and is engaged by the inward end of a damper control element in the form of a screw 97. The screw passes through the door 75 and threadedly through a nut 99, and has a crank 101 to enable turning of the screw to regulate or vary the amount of inward projection of the inner end of the control element.

Figure 3:
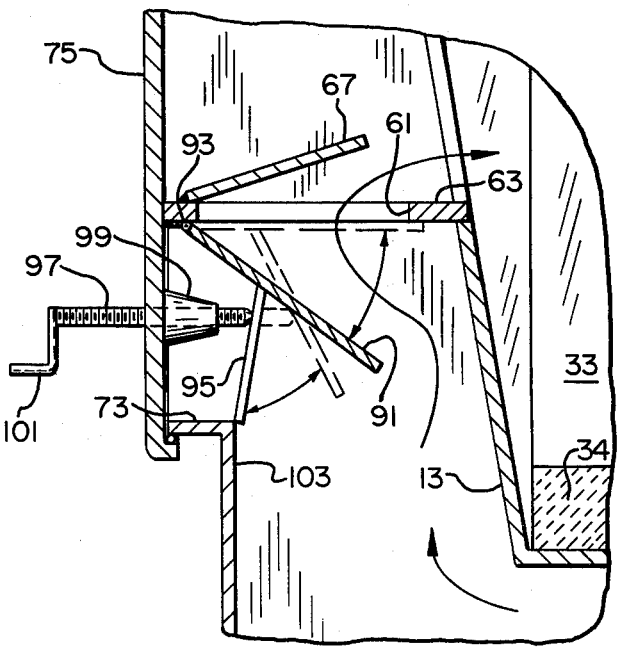
FIG. 3 is an enlarged view of the damper control system in vertical cross section.

As the parts are shown in FIG. 1, the inward projection of the control element is such that the damper is in an intermediate position. FIG. 3 shows in full lines the control element being retracted further to a point where the arm 95 engages an interior corner 103 so that the damper door 91 can move no further open than as shown in full lines, even in the absence of the control element, which in FIG. 2 is disposed in spaced relation from the arm.

If the control element is threaded inwardly sufficiently, the damper door can be moved to a fully closed position, as shown in broken lines in FIG. 3.

What is claimed is:

1. A wood stove having a main housing defining an interior fuel combustion chamber within which fuel is burned and combustion air delivery means defining an air passageway for the passage of combustion air upwardly beneath the main housing and to the fuel combustion chamber, said combustion air delivery means providing a damper opening communicating with the interior combustion chamber of the housing, a damper door pivotally mounted to said combustion air delivery means for movement from a closed position relative to said damper opening to various open positions, means defining a main fuel receiving opening at the front of the stove through which fuel is deposited into the fuel combustion chamber, a stove door for closing the fuel receiving opening and being mounted for movement from a closed position to an open position, and damper control means carried by said stove door for controlling the position of said damper door.

2. A stove as recited in claim 1 in which said damper opening lies in a horizontal plane and in which said stove door lies in a vertical plane, said damper control means including a control element adjustably mounted on said stove door for inward and outward movement for operative engagement with said damper door when said stove door is closed to shift said damper door to various open positions while the stove door is closed.

3. A stove as recited in claim 2 in which said control element comprises a screw, said door providing screw threads operatively engaging said screw whereby turning movement of said screw varies the amount of its inward projection.

4. A stove as recited in claim 3 in which said damper door has a downwardly projecting arm engageable by said control element.

5. A stove as recited in claim 4 in which the arm is obliquely disposed relative to the plane of the damper door.

6. A stove as recited in claim 4 in which the arm is dimensioned relative to said combustion air delivery means so as to abut said combustion air delivery means whenever the stove door is opened to dispose the damper door at a predetermined open position upon opening of the stove door.

7. A stove as recited in claim 2 including air deflection baffle means positioned above the damper opening to deflect air traveling upwardly through the damper opening toward the fuel combustion chamber of the wood stove.

* * * * *